US007481138B1

(12) United States Patent
Chapin

(10) Patent No.: US 7,481,138 B1
(45) Date of Patent: Jan. 27, 2009

(54) ADJUSTABLE BIT TOOL FOR DRIVING SCREWDRIVER SCREWS AND BOLTS

(76) Inventor: Joseph Powell Chapin, 5114 Edgemoor La., Bethesda, MD (US) 20814

( * ) Notice: Subject to any disclaimer, the term of this patent is extended or adjusted under 35 U.S.C. 154(b) by 0 days.

(21) Appl. No.: 12/014,899

(22) Filed: Jan. 16, 2008

(51) Int. Cl.
*B25B 23/02* (2006.01)

(52) U.S. Cl. ..... 81/442; 81/439

(58) Field of Classification Search ..... 81/442, 81/448, 124.5, 185, 177.6, 439
See application file for complete search history.

(56) References Cited

U.S. PATENT DOCUMENTS 1,155,675 A * 10/1915 Mueller ..... 81/124.5
1,501,222 A * 7/1924 Lamp ..... 81/439
1,618,715 A * 2/1927 Lammers et al. ..... 81/185
1,896,949 A 2/1933 John
2,822,714 A * 2/1958 Paparelli ..... 81/439
3,127,798 A 4/1964 Gol
3,674,070 A 7/1972 Mahoney
4,197,889 A 4/1980 Peterson
4,307,634 A * 12/1981 Gentry ..... 81/185
5,157,995 A 10/1992 Nogues
5,163,344 A 11/1992 Mathers
5,287,778 A 2/1994 Cook
5,791,209 A 8/1998 Marks
6,467,379 B1 10/2002 Wizman
7,150,209 B1 12/2006 Loomis et al.

* cited by examiner

*Primary Examiner*—Hadi Shakeri
(74) *Attorney, Agent, or Firm*—Millen, White, Zelano & Branigan, P.C.

(57) ABSTRACT

A tool has an adjustable bit array of individual bit elements arranged along a longitudinal axis. The bit element to be used is selected by slightly rotating and then sliding an operating rod fixed to a central bit element that has the smallest diameter. Successively larger bit elements are coupled to the central bit element in a cascading relationship. The operating rod is locked selectively in locking slots, each of which is associated with one of the bit elements.

15 Claims, 11 Drawing Sheets

ADJUSTABLE BIT TOOL FOR DRIVING SCREWDRIVER SCREWS AND BOLTS

FIELD OF THE INVENTION

This invention relates to adjustable bit tools, such as screwdrivers. More particularly, this invention relates to single tools having a bit array comprised of a plurality of bit elements of different sizes.

BACKGROUND OF THE INVENTION

Screwdrivers and bolt drivers used to advance and retract screws and bolts have heads with indentations therein known as "Phillips heads," which are rotated by Phillips head bits. Phillips head bits are available in a number of sizes and configurations. These bits are currently configured as separate elements which may be interchangeably mounted in screwdriver handles. Since the bits are separate elements, they can become lost or misplaced so that the most desirable bit is not always available for use. Currently, there is no arrangement available wherein an array of different size bit elements are associated with a single tool to provide a more convenient arrangement for operating Phillips head screws and bolts.

SUMMARY OF THE INVENTION

A cascade arrangement used for rotating screws and bolts comprises an adjustable bit having a longitudinal axis. Around the axis an array of concentric bit elements are cascaded in nested relationship with a central bit element being separately connected to successively larger bit elements. An operator is coupled to the central bit element for translating the central bit element to successively position individual bit elements for use in rotating screws and bolts. A locking arrangement is provided for locking the operator in selected positions corresponding to positions of the selected positions for the bits.

In alternative arrangements of the invention, the bits are configured for mating with Phillips head screws or bolts, for driving Allen head bits or for fitting in polygonal sockets of other types screws and bolts.

In a further aspect of the invention, the operator is a rod connected to the central bit element.

In still a further aspect of the invention, the locking arrangement comprises a button on the operator, which is movable on the support for the bits, the support having locking stations, each of which corresponds to exposure of a selected one of the bits for use.

In a further aspect of the invention, the support is a tool handle.

In still a further aspect of the invention, the button comprises a spring-biased detent, which registers with a selected one of a plurality of keepers comprising the locking stations.

In still a further aspect of the invention, the tool handle is an elongated handle having a longitudinally extending slot therein which guides the button.

In still a further, more specific aspect of the invention, the rod is rotatable with respect to the subsequent bit elements and has outwardly extending projections. The larger bit elements which are positioned radially inboard of the central bit element, each include an annular internal disc having radially extending slots therethrough, through which slots the projections on the rod can pass when aligned with the slots. Accordingly, as the rod is rotated, the successive bit elements are exposed for use, the rod being locked at locking stations with the button so as to prevent a selected bit element from retracting further.

In a further aspect, the subsequent bit elements are restrained against rotation with respect to one another and with respect to the tool handle with the central bit element restrained from rotation only when fully projected.

In still a further aspect of the invention, bit elements are restrained by rib and slot connections between the elements.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
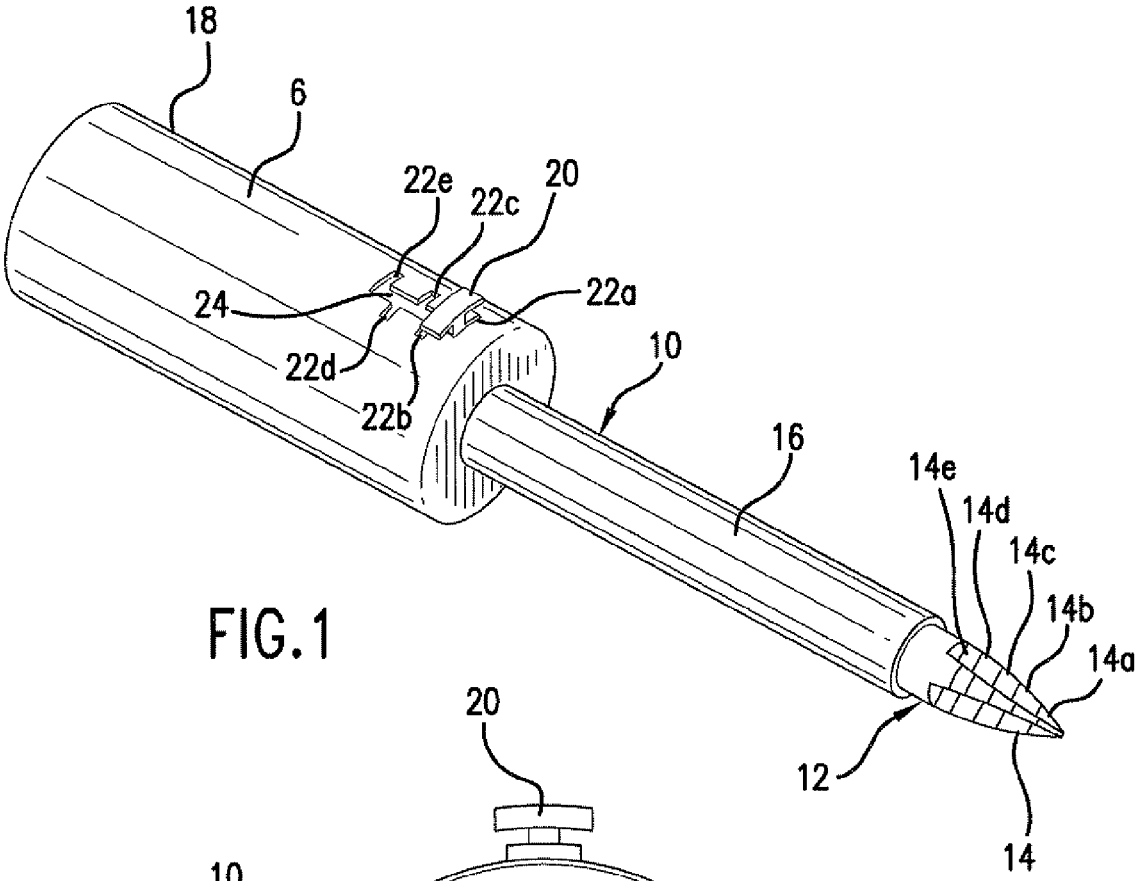
FIG. 1 is a perspective view of a tool with adjustable bits configured in accordance with the principles of the present invention.

Referring now to FIG. 1 there is shown a tool 10 configured in accordance with the instant invention wherein the tool comprises an array 12 of bits 14*a*-14*e* attached to a support tube 16 that is fixed to a handle 18. As will be further explained hereinafter, the individual bits 14*a*-14*e* are arranged sequentially in a cascading relationship and are selected by positioning a button 20 in locking stations 22*a*-22*e* positioned laterally of a longitudinal slot 24. As the locking button 20 is positioned in a selected one of the slots forming locking stations 22*a*-22*e*, a corresponding bit 14*a*-14*e* is selected from the bit array 12.

Figure 2:
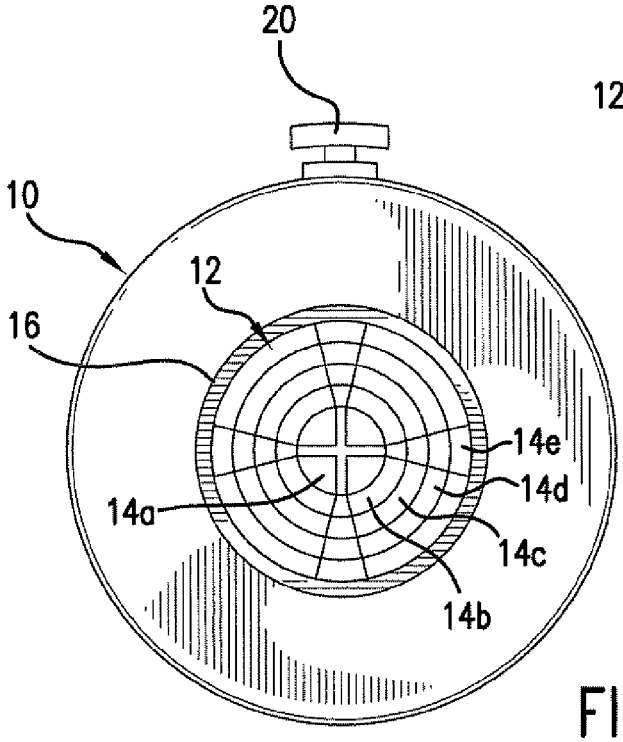
FIG. 2 is an end view of the tool of FIG. 1.

As is evident from the structure of FIG. 2 when combined with that of FIG. 1, the bits 14*a*-14*e* are in one embodiment Phillips head bits used with Phillips head screws or bolts. Alternatively, the bits may be Allen bits for Allen head screws or bolts, or for any type of polygonal bits used for polygonal sockets in the heads of screws or bolts. The arrangement applies to any bits which may be nested, such as flat head bits, wherein according to the present invention smaller bits are received in larger bits Referring now to FIGS. 3A-3C, portions of the handle 18 and support tube 16 are shown in elevation to illustrate cooperation of the button 20 and longitudinal slot 24 with respect to an operating rod 30 extending along an axis 31. The rod 30 serves as an operator for the bit array 12 shown in FIGS. 1 and 2. As will be further explained hereinafter, the operator rod 30 is fixed to the central bit element 14*a* of the bit array 12. Longitudinal reciprocation in the direction of arrows 32 (FIG.

Figure 3A:
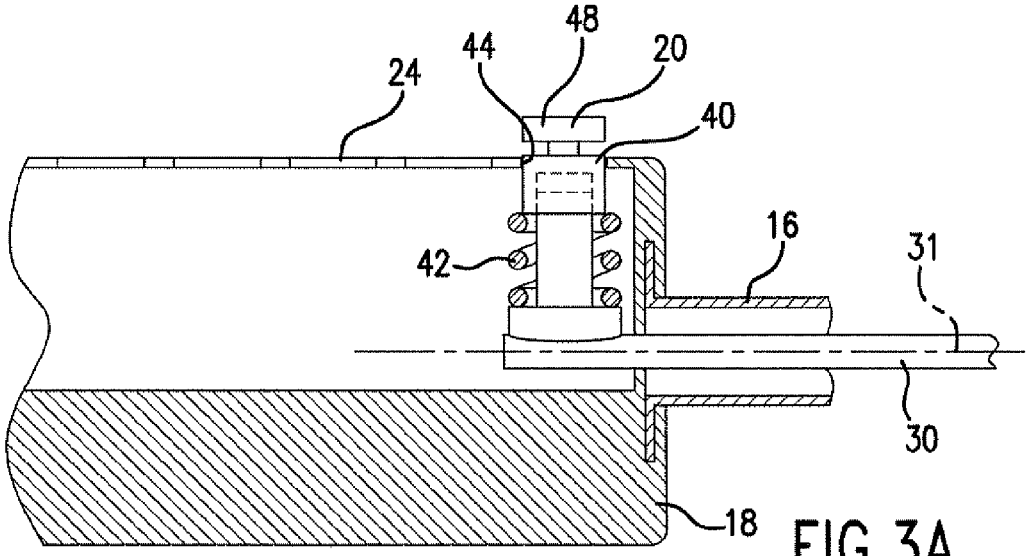
FIG. 3A is an elevation through the support tube showing an operator rod for the bits being locked in a first position.
Figure 3B:
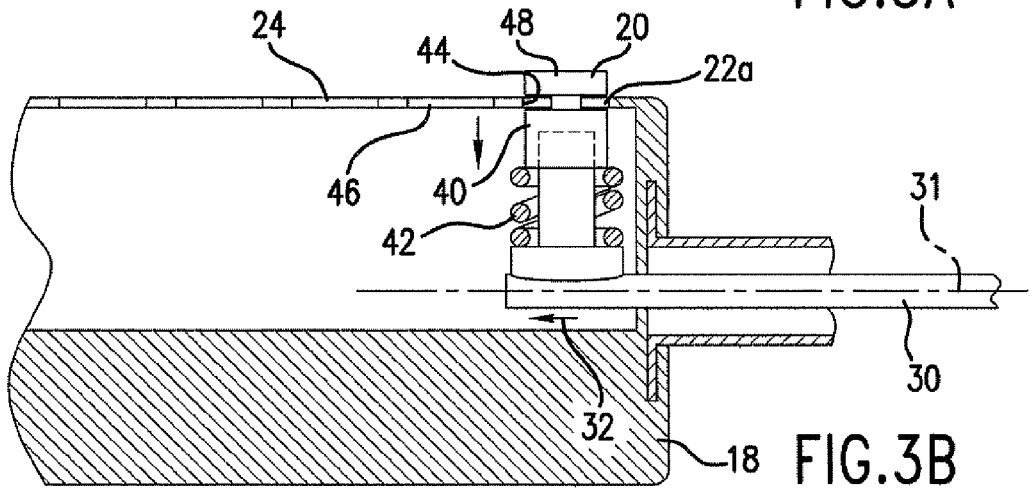
FIG. 3B is a view similar to FIG. 3A but showing the operator rod being unlocked by rotating the operating rod.
Figure 3C:
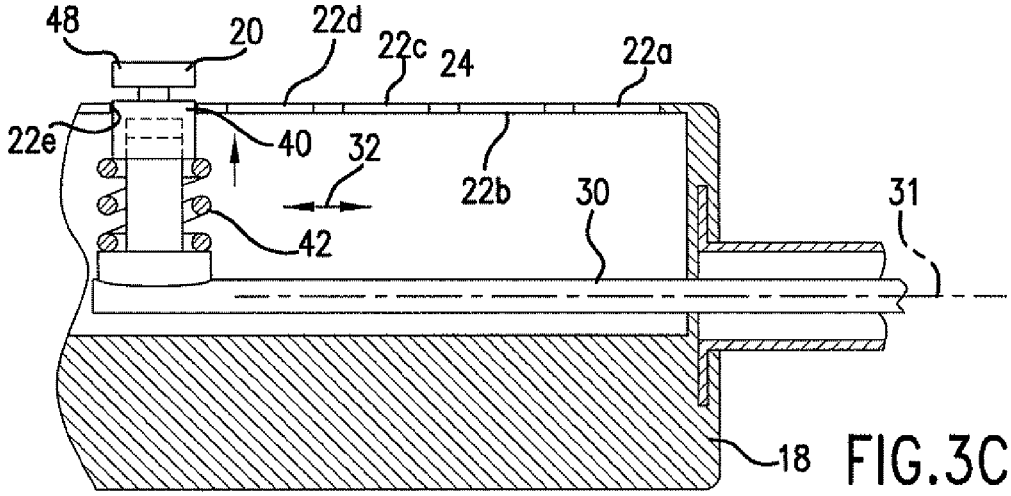
FIG. 3C is a view similar to FIGS. 3A and 3B but showing the rod being moved by sliding to another locked position to select and lock another bit for rotation by the tool handle.

3C) allows the rod 30 to be reciprocated from the FIG. 3A position to the FIG. 3C position in the direction of the arrows 32. As is seen in FIG. 3A the button 20 is attached to a detent shoulder 40 that is urged by a coil spring 42 to project into a selected one of locking stations 22*a*-22*e*. In FIG. 3A, the locking station illustrated is 22*a*. The detent shoulder 40 engages peripheral walls 44 of the locking station 22*a* and prevents the button 20 and thus the operating rod 30 to which it is attached from moving longitudinally in the direction of arrows 32. Upon depressing the button 20 against the bias of the coil spring 42, a slot 44 between the detent 40 and the button 20 allows the button 20 to slide between the edges 46 of the slot 24. With the top portion 48 of the button above the edges 46 and the detent 40 below the edges 46.

As is seen in FIG. 3B, when the button 20 is pressed the rod 30 is free to rotate in the direction of arrow 50 so that the button 20 can move out of the locking station 22*a* and into the slot 24 wherein the rod 30 can move in the longitudinal direction 32 to another station, such as for example locking station 22*b* or any of the locking stations 22*c*-22*e* of FIG. 1. As will be explained hereinafter, the structure of the bit array 12 is configured to accommodate the simple rotating and sliding motion of the operator rod 30.

Figure 4A:
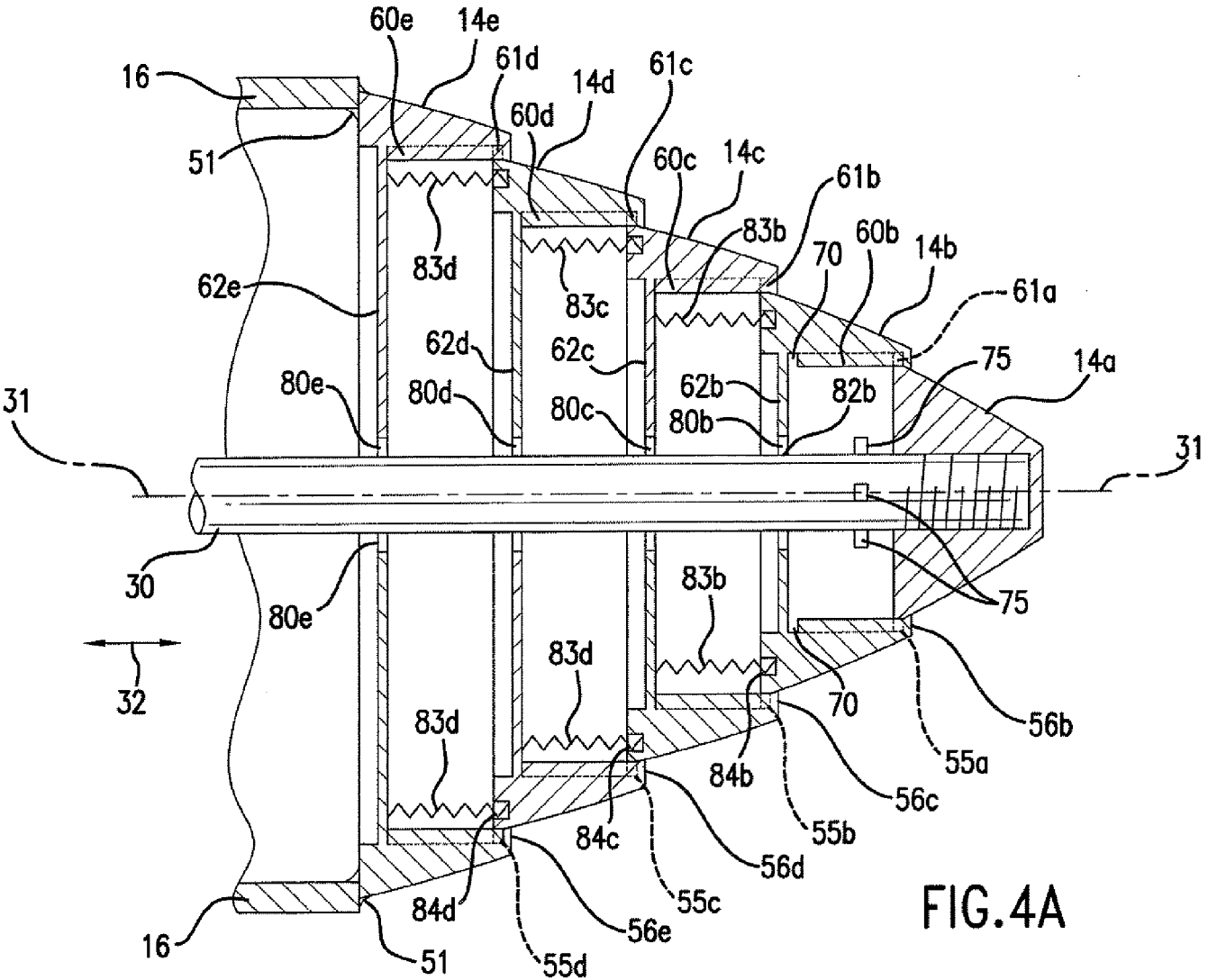
FIGS. 4A-4E are enlarged elevations showing the central bit, which is the smallest bit projected for use and progressively retracted to expose bits of increasing diameter for use.

Referring to FIG. 4A it is seen that the bit array 12 is fixed with respect to the support tube 16 at area 51 by welding or otherwise securing the largest, rearmost bit 14*e* to the support tube 16 so that the largest bit is restrained from rotation about the axis 31 of the rod 30 and therefore the handle 18 of the tool 10 (FIG. 1). As is seen in FIGS. 4A-4E, each of the successively larger bit elements 14*b*-14*d* are also restrained from rotation with respect to the mounting tube 16 and the handle 18 because they can not rotate with respect to the largest bit element 14*e*. In a preferred embodiment, this is accomplished by ribs 60*b*-60*e* extending inwardly from the bit elements 14*b*-14*e*. The ribs 60*b*-60*e*, preferably four in number on each bit element 14*b*-14*e*, are received in slots 61 formed in radially extending retaining flanges 62*b*-62*e* extending from each of the successively larger bit elements 14*b*-14*e*. Consequently, the rib elements 14*b*-14*e* are restrained from rotation with respect to one another as they move from the FIG. 4A configuration to the FIG. 4E configuration.

It is only necessary that the rod 30 rotate sufficiently to let the button 20 seat in one of the selected locking stations 22*a*-22*e*. This is accomplished by having the rib 60*b* have a length in the direction of axis 31, which is shorter by virtue of a gap 70. Consequently, the operating rod 30 is pulled back into handle 18 it can rotate with respect to the ribs 60*b* because the retaining flange 62*a* clears the ribs 60*b* and can rotate in the gap 70.

In order to lock the bit elements 14*a*-14*e* with respect to one another, the rod 30 has four projections 75 spaced at a locking location 76 positioned behind the smallest bit 14*a* in spaced relation thereto to provide a gap 77.

FIGS. 4A-4E show the bits 14*a*-14*e* mounted in nesting rotation on the rod 30 while FIGS. 5A-5E show the bits 14*a*-14*e* individually. As is explained hereinafter, the bits 14*b*-14*e* are not rotatable but can slide sequentially with respect to one another, while the smallest bit 14*a* can both rotate slightly to decouple from the bit 14*b*-14*e* and slide to select the bit to be used. The radial slots 80*b* extending from central opening 82*b* in the retaining flange 62*b* receive the pins 75 therethrough when the pins are aligned with the slots. This alignment is accomplished when the rod 30 is rotated by moving the button 20 from the locking station 22*a* to the slot 24 so the rod 30 can slide in slot 24 of FIGS. 1 and 3A-3B.

After the projections 75 on the rod 30 move through the slots 80*b* in the retaining flange 62*b* by continuing to retract the rod 30, the projections 75 position behind the retaining flange 62*b*. The rod 30 is then rotated with the button 20 so that the detent shoulder 40 seats in the next locking slot 22*b*. The bits 14*a*-14*e* are then positioned as shown in FIG. 4B with the second bit 14*b* exposed for use and locked against rearward movement by the pins 75.

Figure 4B:
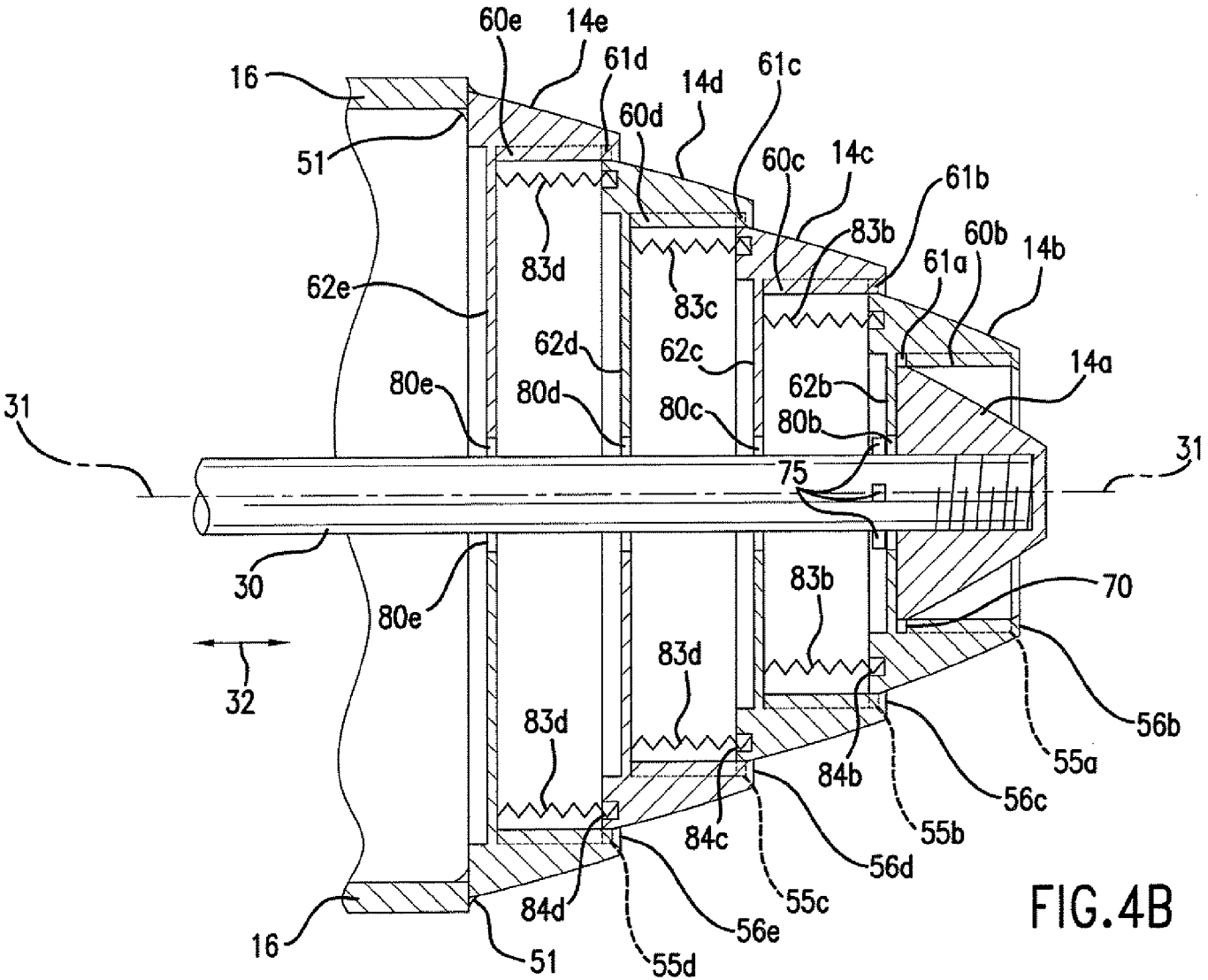

In order to keep the bits 14*b*-14*d* projected during the transition of the bit 14*a* from the FIG. 4A position to the FIG. 4B position, the bits 14*b*-14*d* are urged to the projected position by springs 83*b*-83*d*. Preferably, there are four springs 83*b*-83*d* extending from each retaining flange 62*c*, 62*d* and 62*e*, however three springs or two springs may also work. The springs 83*b*-83*d* extend from the retaining flanges 62*c*, 62*d* and 62*e* into bores 84*b*, 84*c* and 84*d* in the bits 14*b*, 14*c* and 14*d* and help stabilize the bits by restoring the sequential, cascading relationship. The bit 14*e* is stationary anyway because it is welded to the support tube 16 on the handle 18. In FIG. 4B the springs 83*b* are compressed into bores 84*b* in bit 14*b* while springs 83*c*-83*e* remain extended. The outside surface of bit 14*b* is then at the front of the screwdriver 10 and is ready for use.

Figure 4C:
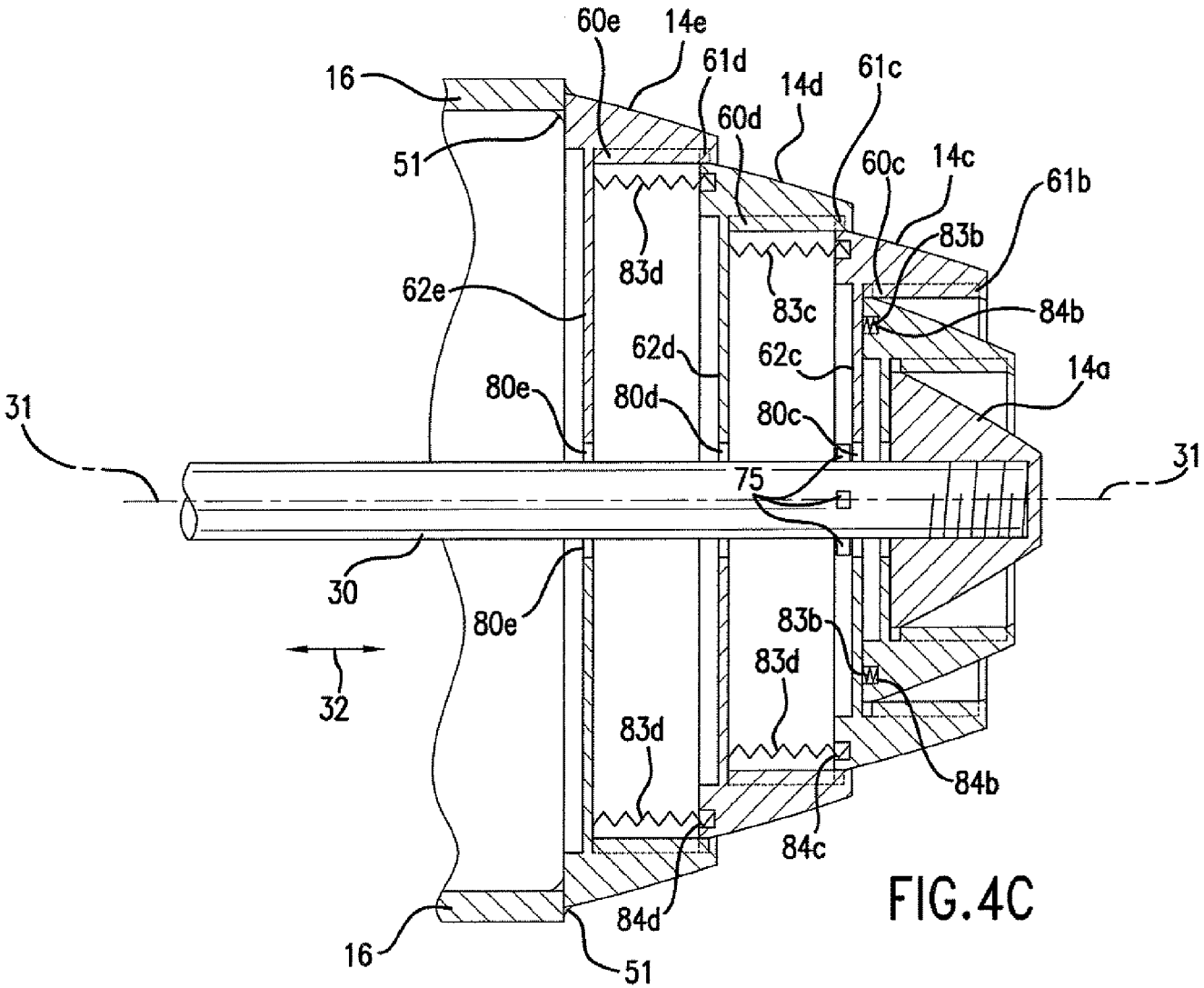

When it is desired to use bit 14*c*, bit 14*c* is exposed by retracting bits 14*a* and 14*b* into bit 14*c*, as shown in FIG. 4C. As is seen in FIG. 4C, the springs 83*b* are compressed into bores 84*b* in bit 14*b* and pins 75 are behind retaining flange 62*c*. The springs 83*d* and 83*e* remain extended and the outside surface of the bit 14*c* is at the front of the screwdriver 10 and is ready for use.

Figure 4D:
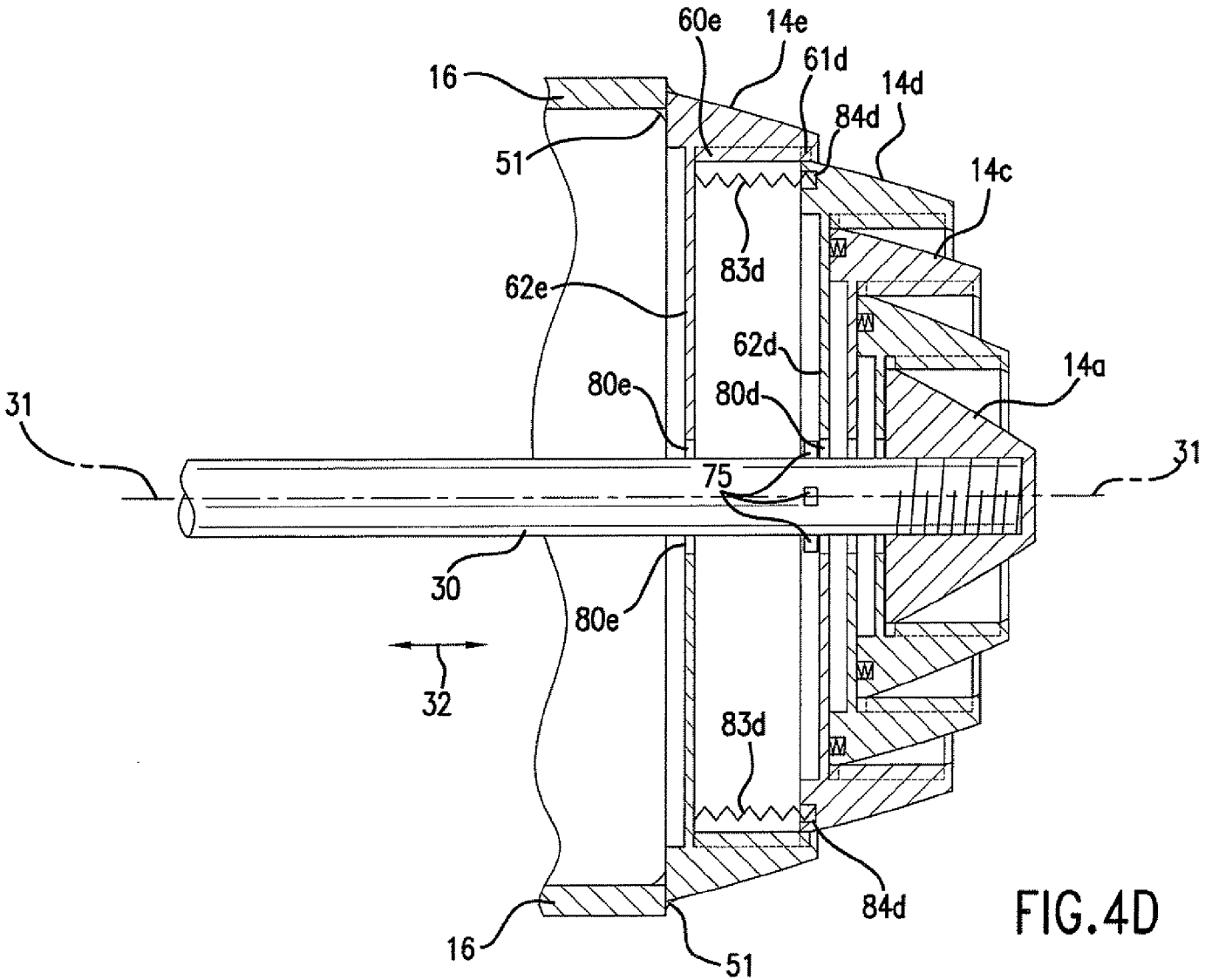

When it is desired to use bit 14*d*, bit 14*d* is exposed by retracting bits 14*a*, 14*b* and 14*c* into bit 14*d*, as is shown in FIG. 4D. As is seen in FIG. 4D, the springs 83*d* are compressed into bore 84*d*, while springs 83*b* and 83*c* are compressed into bores 84*b* and 84*c*, respectively. Only the springs 83*e* and 83*d* remain extended and the outside surface of the bit 14*d* is at the front and of the screwdriver 10 and is ready for use.

Figure 4E:
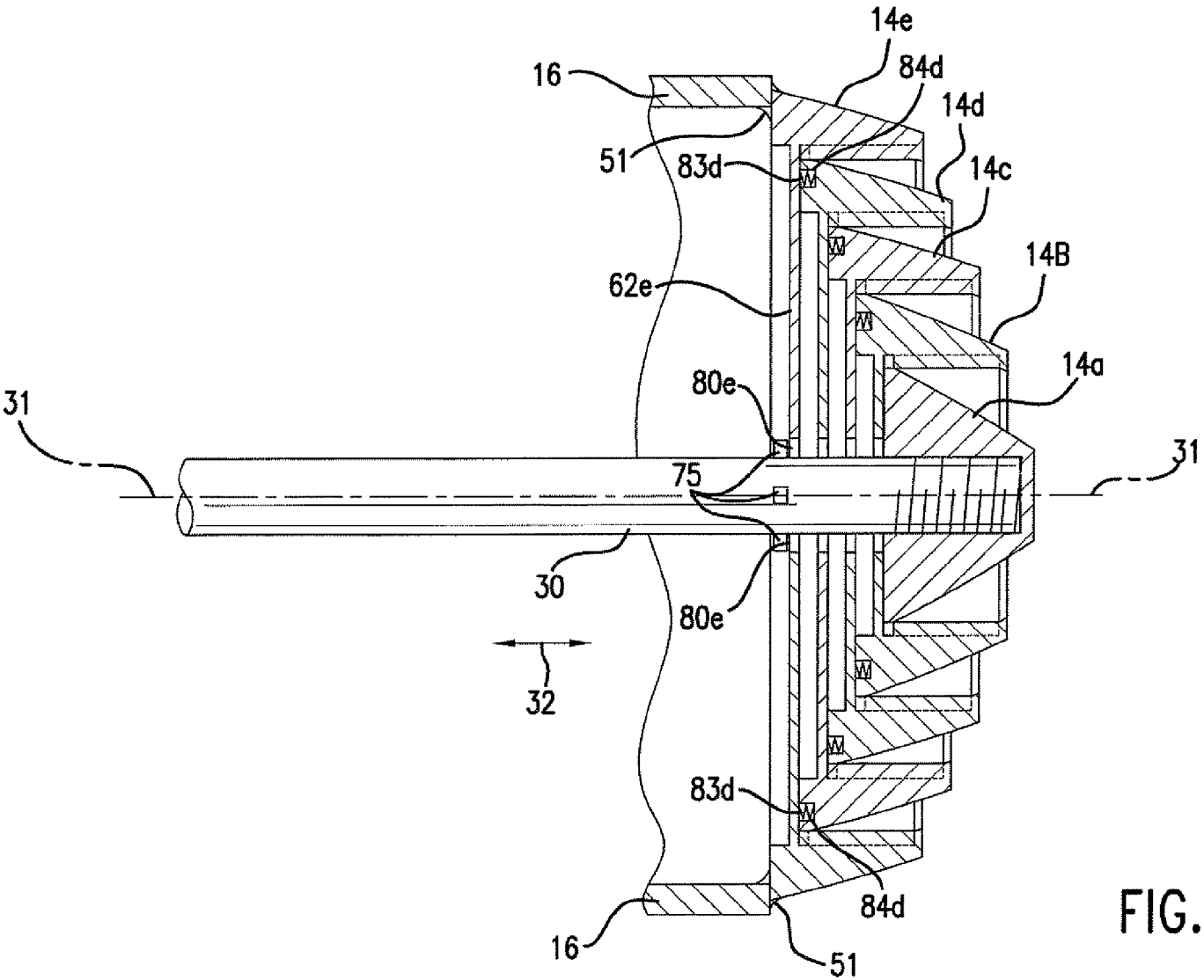
Figure 5B:
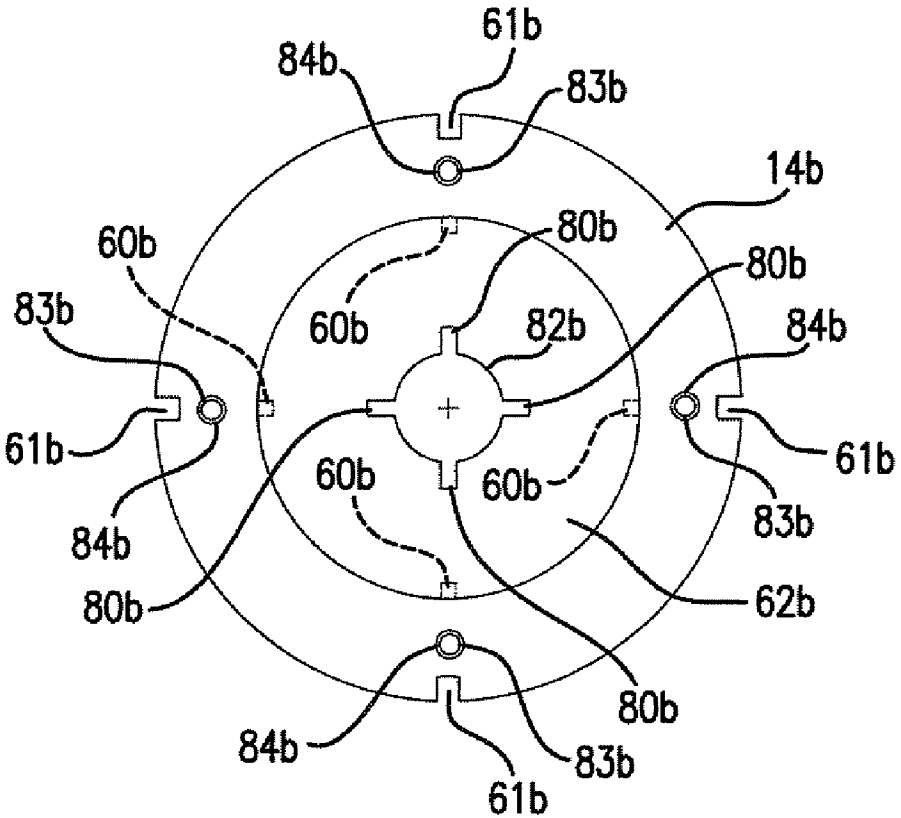
FIGS. 5A-5E are enlarged planar views of successive individual retaining flanges forming part of the individual bits used with the successive bits shown in FIGS. 1, 2 and 4A-4E.
Figure 5A:
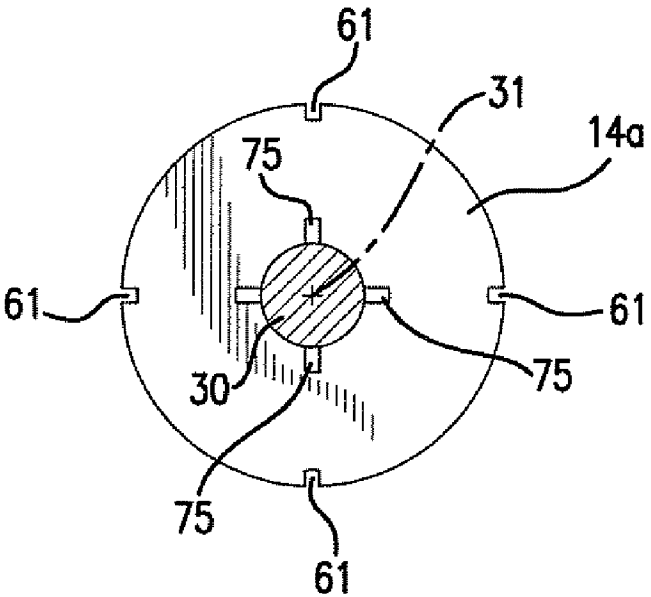
Figure 5C:
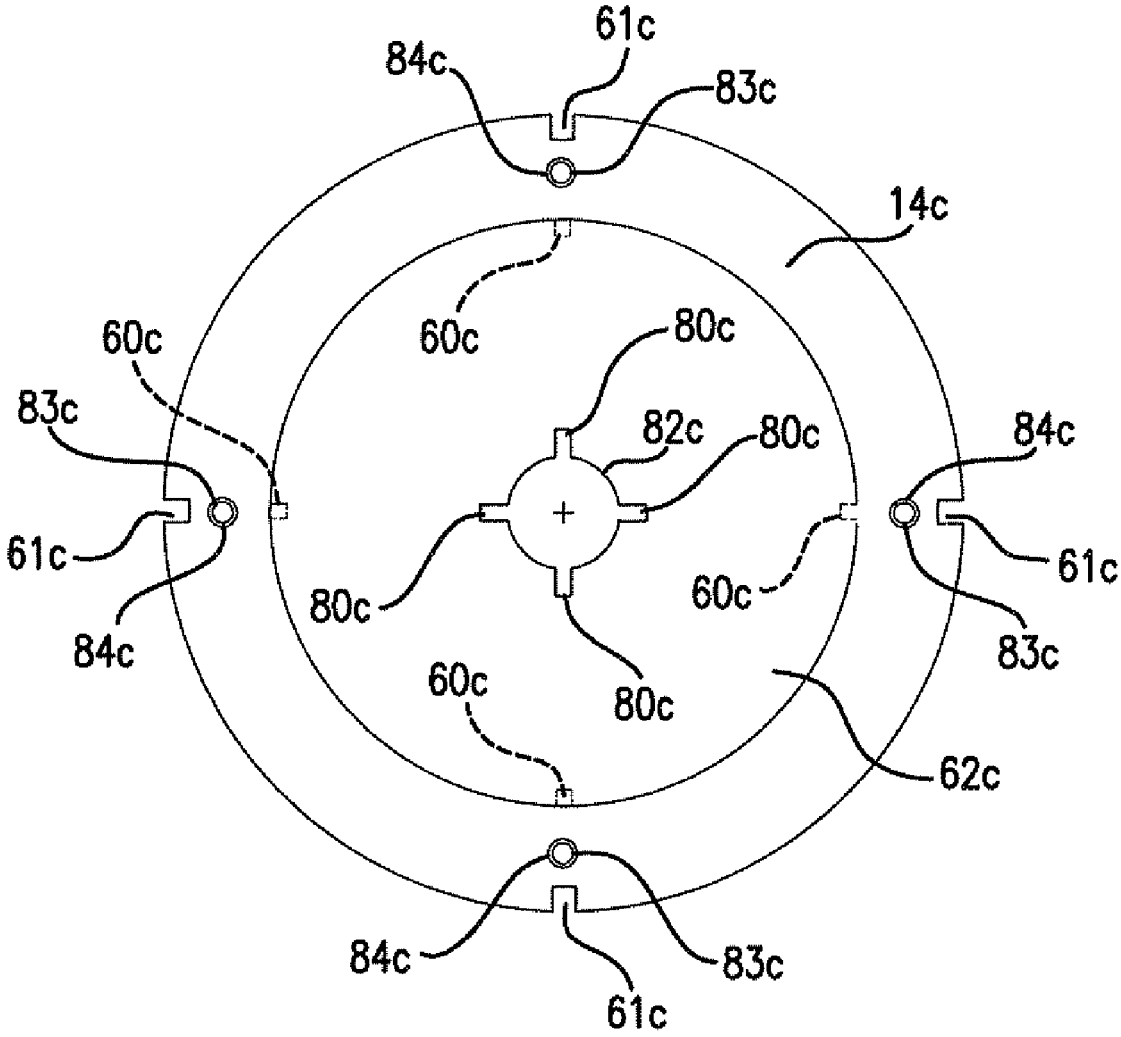
Figure 5D:
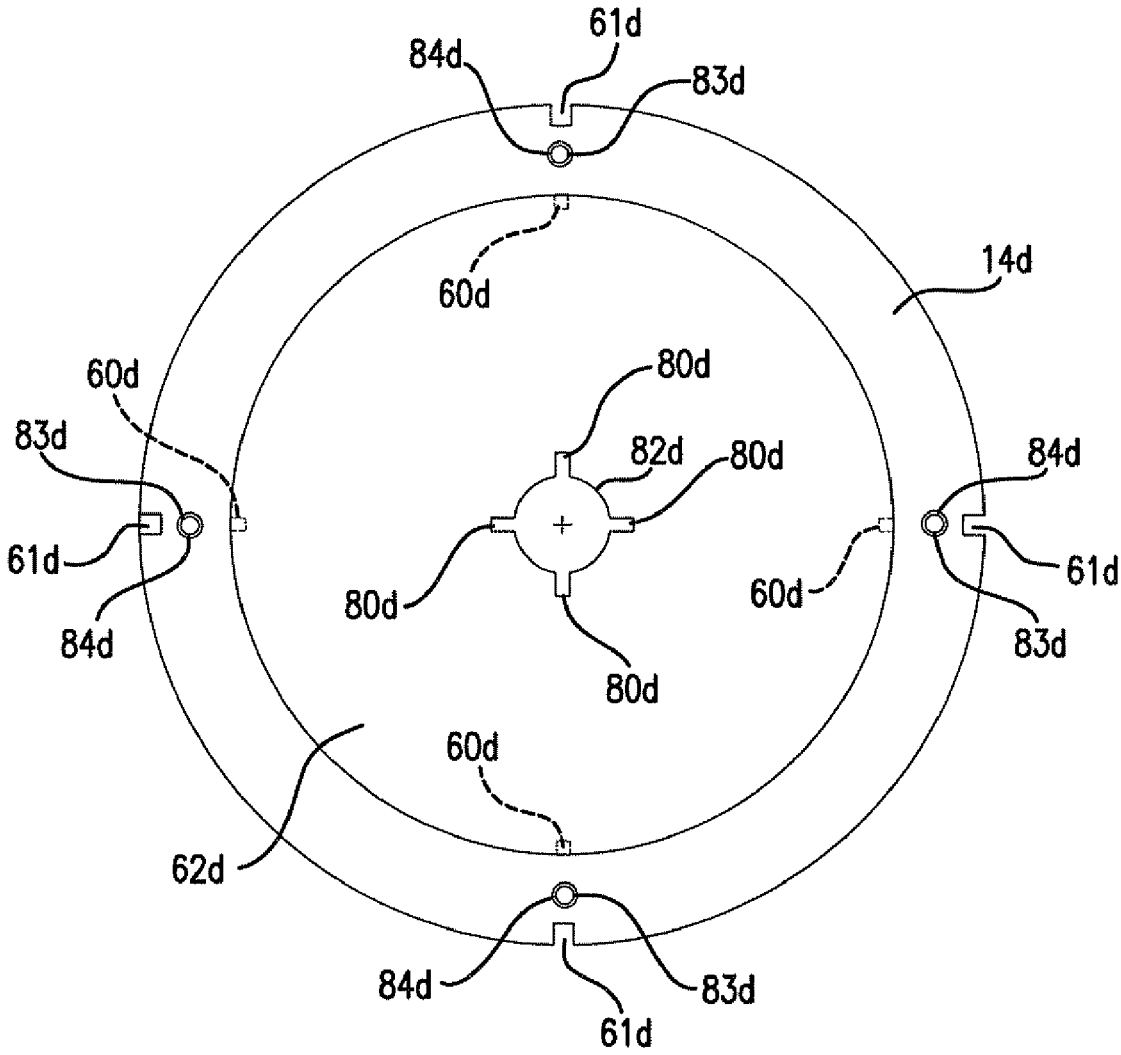
Figure 5E:
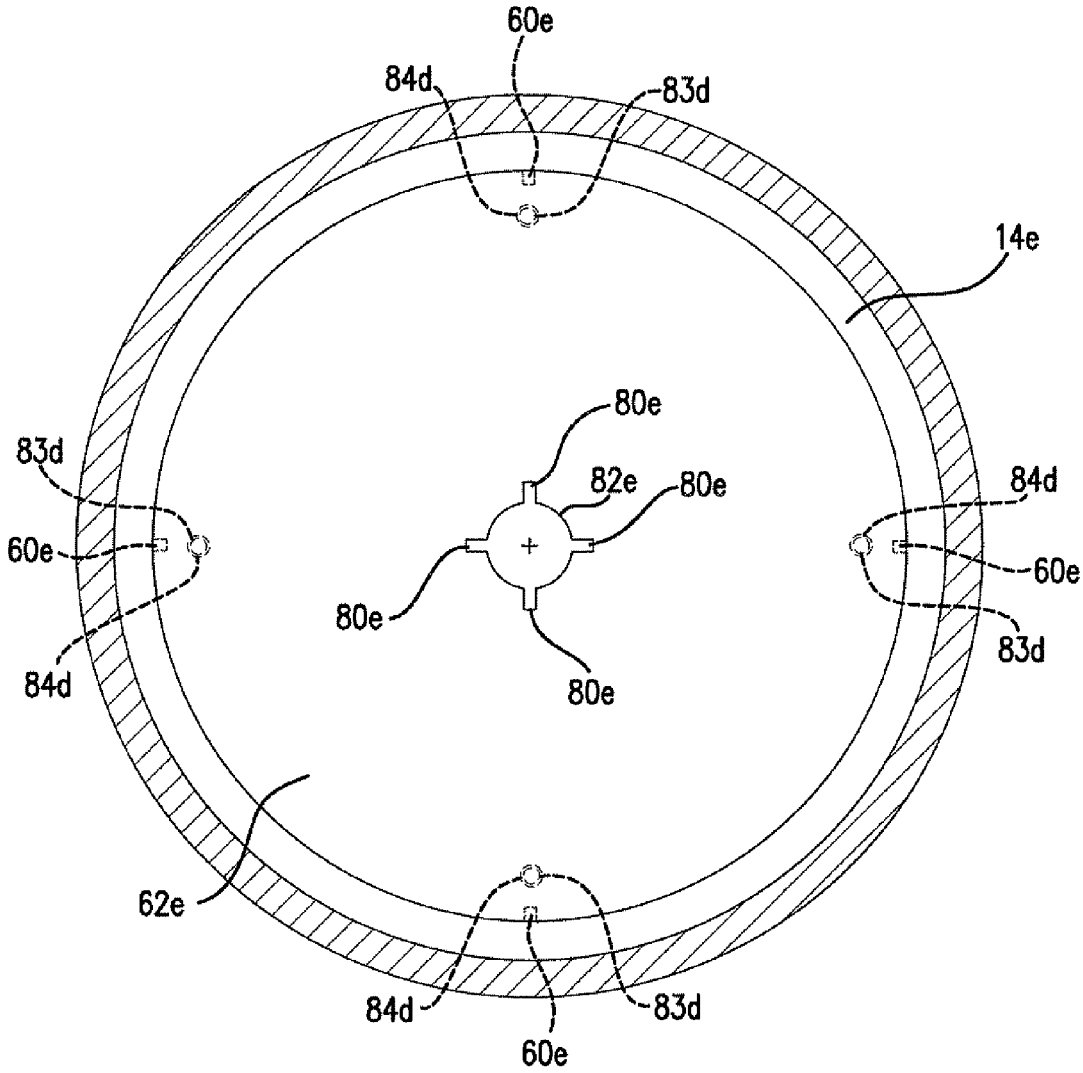

When it is desired to use bit 14*e*, bit 14*e* is exposed by retracting bits 14*a*, 14*b*, 14*c* and 14*d* into bit 14*e*, as is shown in FIG. 4E. As is seen in FIG. 4E, the springs 83*e* are compressed into bores 84*d* and no springs remain extended and the outside surface of the bit 14*e* is at the front end of the screwdriver 10 and is ready for use.

In order to select a bit element 14*a*-14*d* of a smaller diameter, the operating rod 30 is slid to the selected forward to the FIG. 4A position and thereafter pulled back to one of the selected positions 14*b*-14*e*. The button 20 rotated into the selected one of the locking slots 22*a*-22*e*.

In order to select a bit element 14*a*-14*d*, the button 20 is rotated out of the locking station 22*a*-22*e* that it is in and then pushed or pulled to the desired locking station by sliding in the longitudinal slot 24. While the button 20 is in the longitudinal slot, the pins 75 align with the radial slots 80*b*-80*e* in the retaining flanges 62*b*-62*e* which are fixed to the bits 14*b*-14*e*, respectively, so that the operating rod 30 can slide with respect thereto. Abutment of the rear shoulders 55*a*-55*d* with the front lips 56*b*-56*e* pulls the bits 14*b*-14*d* forward as the smallest bit 14*a* is advanced by the button 20. The springs 83*b*-83*e* also urge the bits 14*a*-14*d* forward (to the right in the drawings). When the desired one of the bits 14*a*-14*d* is placed foremost in the bit array 12, the button is pushed in the selected one of the locking stations 22*a*-22*e*. This rotates the pins 75 behind the selected retaining flange 62*b*-62*e* to lock the bits 14*a*-14*d* in place, as is shown in FIGS. 4*a*-4*e*.

It is emphasized that if the rod 30 is fully retracted with the button in locking station slot 22*e*, it can be fully extended by placing the button 20 in the longitudinal slot 24 and then sliding the button 20 all the way to locking station 22*a*. This is possible because pins 75 align with all of the radial slots 80*b*-80*e*. Since the pins 75 align with all of the radial slots 80*b*-80*e* when button 20 is in the longitudinal slot 24, any one of the locking stations 22*a*-22*e*, and thus any one of the bits 14*a*-14*e*, may be selected.

From the foregoing description, one skilled in the art can easily ascertain the essential characteristics of this invention, and without departing from the spirit and scope thereof, can make various changes and modifications of the invention to adapt it to various usages and conditions.

I claim:

1. An arrangement used for rotating screws and bolts, comprising:

an adjustable bit array having a longitudinal axis around which an array of concentric bit elements are cascaded in nested relationship with a central bit element being sequentially connected to successively larger bit elements;

an operating rod coupled to the central bit element for translating the central bit element to successively position individual bit elements for use in rotating screws and bolts; wherein the operating rod is rotatable with respect to the subsequent bit elements and has outwardly extending projections; wherein the successively larger bit elements each include an annular internal disc having radially extending slots through which the projections on the rod can pass when aligned with the slots; and wherein as the operating rod is retracted the successive bit elements are sequentially exposed so that a selected bit element is exposed for use, and a locking arrangement for locking the operating rod at locking stations to prevent the selected bit element from retracting further.

2. The arrangement of claim 1 wherein the bits are configured for mating with Phillips head screws.

3. The arrangement of claim 1 wherein the bits are configured for fitting in polygonal sockets of screws and bolts.

4. The arrangement of claim 3 wherein the bits are configured for driving Allen head bits.

5. The arrangement of claim 1 wherein the locking arrangement includes a button projecting from the rod that is movable on a support for the bits, the support having locking stations, each of which corresponds to exposure of a selected one of the bits.

6. The arrangement of claim 5 wherein the button comprises a spring biased detent, which registers with a selected one of a plurality of keepers comprising the locking stations.

7. The arrangement of claim 6 where the support is an elongated tool handle having a longitudinally extend slot therein which guides the button.

8. The arrangement of claim 5 wherein the subsequent bit elements are restrained against rotation with respect to one another and to the support, the initial bit element being restrained from rotation only when fully projected.

9. The arrangement of claim 8 wherein the support is a tool handle.

10. An arrangement used for rotating screws and bolts, comprising:

a tool handle with a support tube extending therefrom;

an adjustable bit array within the support tube and having a longitudinal axis around which an array of concentric bit elements are cascaded in nested relationship with a central bit element being sequentially connected to successively larger bit elements;

an operating rod coupled to the central bit element for translating the central bit element to successively position individual bit elements for use in rotating screws and bolts; wherein the operating rod is rotatable with respect to the subsequent bit elements and has outwardly extending projections; wherein the successively larger bit elements each include an annular internal disc having radially extending slots through which the projections on the operating rod can pass when aligned with the slots, and wherein as the operating rod is retracted the successive bit elements are sequentially exposed so that a selected bit element is exposed for use, and a locking arrangement for locking the operating rod at locking stations to prevent the selected bit element from retracting further, wherein the locking arrangement includes a locking button projecting through a slot in the handle and connected to the operating rod for positioning the operating rod at the operating stations.

11. The arrangement of claim 10 wherein the bits are configured for mating with Phillips head screws.

12. The arrangement of claim 10 wherein the bits are configured for fitting in polygonal sockets of screws and bolts.

13. The arrangement of claim 12 wherein the bits are configured for driving Allen head bits.

14. The arrangement of claim 10 wherein the button comprises a spring biased detent that registers with a selected one of a plurality of keepers comprising the locking stations.

15. The arrangement of claim 10 wherein the subsequent bit elements are restrained against rotation with respect to one another and the support, the initial bit element being restrained from rotation only when fully projected.

* * * * *